US007344210B2

(12) United States Patent
Dresser

(10) Patent No.: US 7,344,210 B2
(45) **Date of Patent: *Mar. 18, 2008**

(54) BREAK DOWN ICE MERCHANDISER SHROUD

(75) Inventor: Steve Dresser, Necedah, WI (US)

(73) Assignee: Leer Refrigeration, Inc., Fairfield, IA (US)

( * ) Notice: Subject to any disclaimer, the term of this patent is extended or adjusted under 35 U.S.C. 154(b) by 182 days.

This patent is subject to a terminal disclaimer.

(21) Appl. No.: 11/357,272

(22) Filed: Feb. 17, 2006

(65) Prior Publication Data

US 2006/0138910 A1 Jun. 29, 2006

Related U.S. Application Data

(62) Division of application No. 10/848,500, filed on May 18, 2004, now Pat. No. 7,032,401.

(60) Provisional application No. 60/517,541, filed on Nov. 5, 2003.

(51) Int. Cl.
*A47B 43/00* (2006.01)

(52) U.S. Cl. ..... 312/401; 312/263

(58) Field of Classification Search ..... 312/257.1, 312/263, 140, 265.1–265.4, 204, 116, 401, 312/406, 406.2, 236; 403/252, 253, 403; 62/246–256; 220/4.28, 4.31, 4.32, 4.33; 52/282.3, 282.1, 281

See application file for complete search history.

(56) References Cited

U.S. PATENT DOCUMENTS

| | | | | | |
|---|---|---|---|---|---|
| 383,859 | A | * | 6/1888 | Chamberlain | 206/425 |
| 1,129,040 | A | * | 2/1915 | McClure | 138/156 |
| 1,711,030 | A | * | 4/1929 | Pifer | 312/140 |
| 1,789,913 | A | * | 1/1931 | Swezey | 62/450 |
| 2,228,221 | A | * | 1/1941 | Bales | 403/217 |
| 2,240,729 | A | * | 5/1941 | Von Palmenberg | 16/390 |
| 2,337,885 | A | * | 12/1943 | Hallam | 52/28 |
| 2,659,515 | A | * | 11/1953 | Miller | 220/684 |
| 3,039,836 | A | * | 6/1962 | Larson | 312/140.3 |
| 3,956,977 | A | * | 5/1976 | Turko et al. | 454/56 |
| 3,998,509 | A | * | 12/1976 | Hauser | 312/263 |
| 4,291,113 | A | * | 9/1981 | Minamizono et al. | 430/202 |
| 4,349,845 | A | * | 9/1982 | Strauss | 348/789 |
| 4,437,412 | A | | 3/1984 | Trautsch | 108/56.1 |
| 4,600,252 | A | * | 7/1986 | Barber | 312/263 |
| 4,604,820 | A | | 8/1986 | Edman | 40/605 |
| 4,611,866 | A | * | 9/1986 | Everett | 312/265.5 |
| 4,618,120 | A | * | 10/1986 | Wattles | 248/460 |
| 4,698,946 | A | * | 10/1987 | Wendt | 52/275 |

(Continued)

*Primary Examiner*—Janet M. Wilkens
(74) *Attorney, Agent, or Firm*—McKee, Voorhees & Sease, P.L.C.

(57) ABSTRACT

A refrigerated merchandiser shroud that can be packaged and transported unassembled and then assembled without tools is disclosed. The unassembled shroud can be readily transported and is resistant to damage during shipping. The refrigerated merchandiser shroud includes a plurality of corner bracket assemblies, a front panel, and two side panels. The corner bracket assemblies include two grooved lip holders and the panels include connecting lips at each side end thereof. The lip holders of the corner bracket assemblies receive the connecting lips of the panels. Each corner bracket assembly is installed along a vertically extending corner of a refrigerated merchandiser. The refrigerated merchandiser shroud is assembled by sliding the connecting lips of each panel into the lip holders of the corner bracket assemblies.

14 Claims, 4 Drawing Sheets

U.S. PATENT DOCUMENTS 4,730,746 A * 3/1988 Yankoff ..... 220/4.28
D331,100 S 11/1992 Jacobsen et al. ..... D23/271
5,257,423 A 11/1993 Jacobsen et al. ..... 4/630
5,267,672 A 12/1993 Jacobsen et al. ..... 222/159
5,284,023 A * 2/1994 Silva et al. ..... 62/77
5,417,081 A 5/1995 Rudick et al. ..... 62/440
5,517,826 A 5/1996 Duffy ..... 62/256
D372,036 S 7/1996 Timura et al. ..... D15/81
5,708,223 A 1/1998 Wyss ..... 73/865.9
5,722,560 A * 3/1998 Mustee et al. ..... 220/630
5,798,223 A * 8/1998 Li et al. ..... 435/69.1
5,813,556 A * 9/1998 Onken ..... 220/4.33
6,094,934 A 8/2000 Rand et al. ..... 62/440
6,257,010 B1 7/2001 Shei et al. ..... 62/252
6,267,255 B1 7/2001 Brush ..... 211/59.4
RE37,630 E 4/2002 Behr ..... 62/80
6,581,389 B2 6/2003 Rudick ..... 62/6
6,817,206 B2 * 11/2004 Shahbaz ..... 62/331
2002/0088244 A1 7/2002 Jennings et al. ..... 62/371
2003/0154733 A1 8/2003 Ruiz et al. ..... 62/246

* cited by examiner

BREAK DOWN ICE MERCHANDISER SHROUD

RELATED APPLICATION

This application is a divisional of U.S. application Ser. No. 10/848,500, titled "Break Down Ice Merchandiser Shroud", filed on May 18, 2004 now U.S. Pat. No. 7,032, 401, and claims priority to U.S. Provisional Application Serial No. 60/517,541, titled "Break Down Ice Merchandiser Shroud", filed on Nov. 5, 2003 and U.S. application Ser. No. 10/848,500, titled "Break Down Ice Merchandiser Shroud", filed on May 18, 2004, now U.S. Pat. No. 7,032, 401, both of which are herein incorporated by reference in their entirety.

FIELD OF THE INVENTION

The present invention relates generally to a shroud for a refrigerated merchandiser. More particularly, the present invention relates to an ice merchandiser shroud in which the shroud is configured for easy assembly and disassembly without tools.

BACKGROUND OF THE INVENTION

Modern marketing of refrigerated items is highly dependent on sales from refrigerated merchandising units at the point of sale. Particularly with refrigerated items, it is important to be able to inspect the quality of an item you are considering purchasing, and whether or not the merchandising unit contains items that you are interested in. The environment in which the merchandiser is used will affect the attributes of a given refrigerated merchandiser. For example, a steel-doored, coin-operated merchandiser may be used outdoors, whereas a glass-doored, readily openable merchandiser may be used within a business. However, a refrigerated merchandiser has certain basic attributes; it must contain sufficient space to contain a useful number of a particular type of merchandise, it must contain a cooling unit to cool the space within the merchandiser, and it must contain some form of access to the contents within the merchandiser. In addition, refrigerated merchandising units are generally provided with a shroud at the top of the merchandiser, above the cooling unit, that serves a "billboard" function and discourages the stacking of other items that may block the efficient dispersal of heat from the unit.

Shrouds for refrigerated merchandiser units have traditionally been fixed, pre-assembled units. These traditional refrigerated merchandiser shrouds consist of four pieces: two end panels, one front panel, and one back panel. These pre-assembled refrigerated merchandiser shrouds are configured to fit around the top perimeter of a refrigerated merchandiser. The end panels are fastened to the front and back panels using two fasteners that may be, for example, hex washer head self-drilling screws (TEK screws). Assemblies over five feet in length generally also require two gusset angles to be fastened to the shroud to secure it to the refrigerated merchandiser.

As refrigerated merchandiser shrouds are fitted to the top of refrigerators and do not generally bear weight during usage, they are typically made of lightweight materials with little structural integrity. Unfortunately, problems often occur during the shipping and handling of these units. Refrigerated merchandiser shrouds are generally subject to various types of stress during shipping that may cause damage. In particular, freight handlers may mistakenly assume the refrigerated merchandiser shrouds are sturdy enough to support weight, leading to damage of the shrouds when freight handlers stack other freight items on top of the shrouds. While printing "DO NOT TOP LOAD" or similar phrases on the packaging helps to avoid this, handlers may not see or may choose to ignore the warning label.

Traditional, pre-assembled refrigerated merchandiser shrouds also raise concerns during usage, as ice company associates frequently handle refrigerated merchandisers by grabbing the top of the refrigerated merchandiser shroud and tipping the merchandiser onto a two-wheel hand truck for movement to a selling location. This causes two problems; it may damage the refrigerated merchandiser shroud, and it may create a safety hazard to the associate if the refrigerated merchandiser shroud tears or fails to support the refrigerated merchandiser during handling.

SUMMARY OF THE INVENTION

The present invention provides a refrigerated merchandiser shroud that may be shipped unassembled and installed at its destination, preferably without requiring the use of tools. As the refrigerated merchandiser shroud can be shipped unassembled, it can be efficiently packaged such that it occupies less space and is much more resistant to damage during shipping. After installation, the shroud may also be readily disassembled if it needs to be moved or replaced. The refrigerated merchandiser shroud is positioned at the top of a refrigerated merchandiser, or similar device such as an ice cabinet. The refrigerated merchandiser shroud surrounds the top of the cooling unit, and may provide a convenient location for display of trademarks or advertisements. The refrigerated merchandiser will generally have access doors that begin several inches below the bottom of the shroud, so the shroud does not interfere with the use of the refrigerated merchandiser.

In one embodiment of the present invention, the refrigerated merchandiser shroud includes a plurality of corner bracket assemblies, a front panel, and two side panels, which are referred to herein collectively as the shroud components. A refrigerated merchandiser is typically a tall rectangular unit having a front, a back, and two sides. The front and back meet the two sides to form four vertically extending corners. The corner bracket assemblies (or corner pieces) of the present invention are installed on the refrigerated merchandiser at an upper portion of each of the vertically extending corners. For new refrigerated merchandisers, the corner bracket assemblies may be pre-installed on the refrigerated merchandiser prior to packaging and shipping. Alternately, for either new refrigerated merchandisers or older refrigerated merchandisers being retrofitted with a new shroud, the corner bracket assemblies may be installed on a refrigerated merchandiser at a later time, prior to placement of the refrigerated merchandiser shroud.

The various shroud components of the present invention are usually shipped unassembled, and may be shipped separate from the refrigerated merchandiser. In one aspect of the present invention, the shroud panels are shipped along with the refrigerated merchandiser in, for example, a corrugated pack, while the corner bracket assemblies are shipped already fixed to the top of the refrigerated merchandiser. This avoids damage to the relatively frail shroud components during shipping. As the corner bracket assemblies are generally fairly durable, they can be handled with less care. Upon receipt, the panels are unpacked and are attached to the refrigerated merchandiser by sliding the panels into the respective corner bracket assemblies. An additional advantage of the refrigerated merchandiser shroud of the present invention is that company associates who may handle the refrigerated merchandiser before or after installation of the shroud are provided with an unobstructed view of the top of the refrigerated merchandiser. This allows them to appreciate the limited structural strength of the shroud, encouraging them to handle it in a way that avoids damage or possible injury. The view also encourages proper treatment of the refrigerated merchandiser itself, which may bear components of the condensers or other systems at the top of the merchandiser which can be damaged by careless handling. If the refrigerated merchandiser needs to be moved after installation for service or relocation, the refrigerated merchandiser shroud of the present invention can be readily un-installed (broken down) in order to continue providing these advantages.

DETAILED DESCRIPTION

Figure 1:
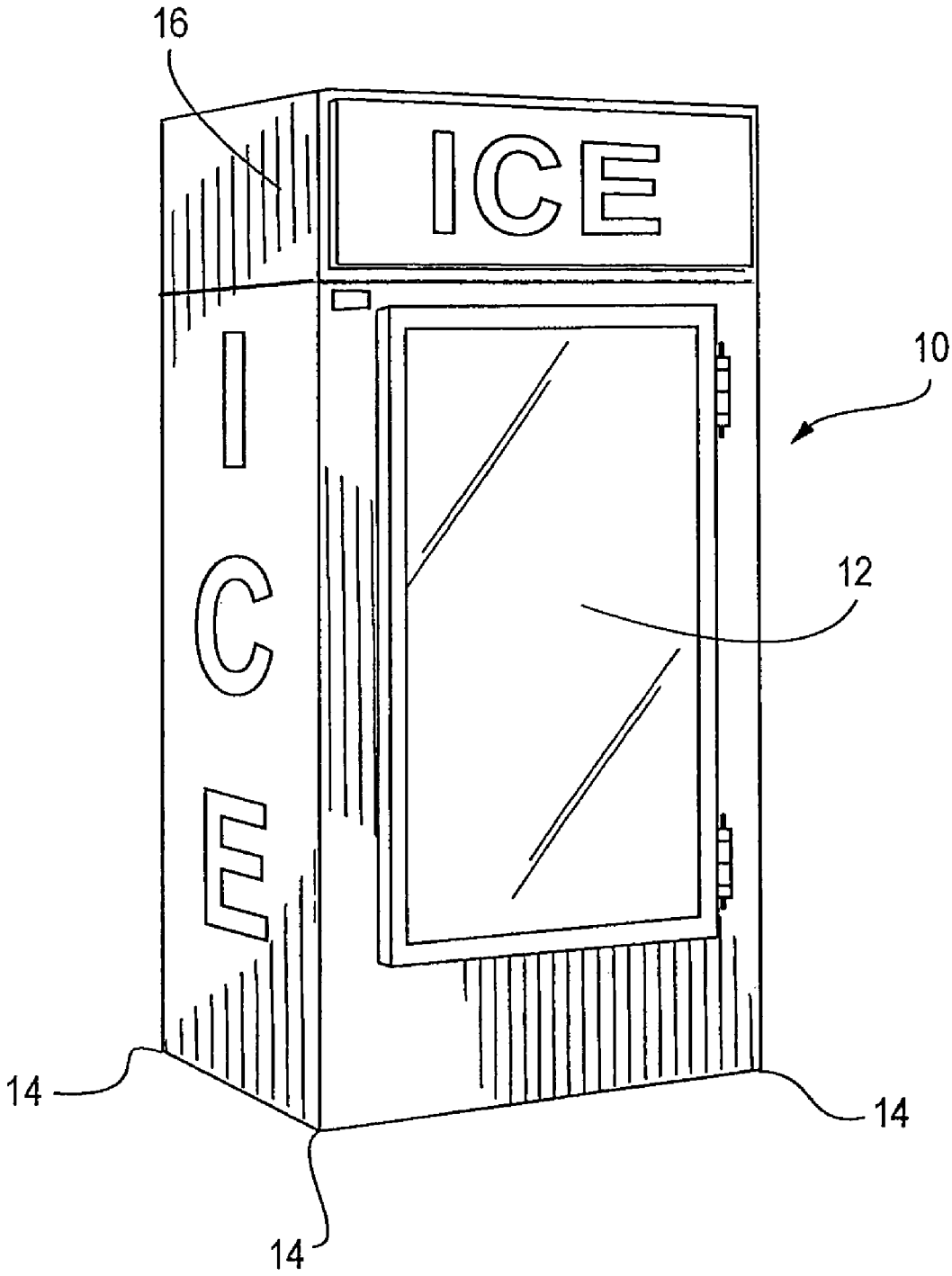
FIG. 1 is a perspective view of a refrigerated merchandiser suitable for use with the refrigerated merchandiser shroud of the present invention.

The following discussion is presented to enable a person skilled in the art to make and use the invention. The present invention is not intended to be limited to the embodiments shown, but is to be accorded the widest scope consistent with the principles and features disclosed herein. The following detailed description is to be read with reference to the figures, in which like elements in different figures have like reference numerals. The figures, which are not necessarily to scale, depict selected embodiments and are not intended to limit the scope of the invention. Skilled artisans will recognize the examples provided herein have many useful alternatives fall within the scope of the invention.

The refrigerated merchandiser shroud of the present invention includes several parts that may be assembled on location. The shroud may thus be shipped as a set of unassembled shroud components, and later assembled and installed at its destination. The refrigerated merchandiser shroud includes a plurality of corner bracket assemblies (or corner pieces), a front panel, and two end panels. Optionally, a back panel may be provided as well.

FIG. 1 shows a refrigerated merchandiser 10 for indoor use that is suitable for use with a refrigerated merchandiser shroud 16 in accordance with the present invention. The refrigerated merchandiser 10 is generally a rectangular cabinet having a front, a back, two sides, a top, and a bottom. The front has a door 12 to the interior of the refrigerated merchandiser 10, where ice or other refrigerated items may be kept. In lieu of the single door 12 shown, the refrigerated merchandiser 10 may have multiple doors or another type of access to the interior of the refrigerated merchandiser 10. These doors provide access to a storage compartment within the refrigerated merchandiser. The front and back of the refrigerated merchandiser meet the two sides to form four vertically extending corners 14. The corners 14 may be sharp or rounded, as desired. In FIG. 1, the corners 14 are sharp. As discussed in relation to FIGS. 4*a* and 4*b*, the corner bracket assemblies of the present invention may be configured in various ways to enable use with different configurations of refrigerated merchandisers. An embodiment of the refrigerated merchandiser shroud 16 is shown positioned at the top of the refrigerated merchandiser 10 in FIG. 1.

Typically the refrigerated merchandiser 10 is of primarily constructed from steel. However, refrigerated merchandisers manufactured of other materials are also suitable for use with the present invention. A cooling unit is generally provided at or near the top of the refrigerated merchandiser 10. Positioning the cooling unit here has the advantage of allowing exhaust heat to rise naturally from the machine, while cold air produced settles into the refrigerated space within the merchandiser. A conventional cooling unit is a vapor compression refrigeration apparatus in which cold is provided by evaporation of a refrigerant under high pressure. Preferably, the walls of the refrigerated merchandiser are insulated in some way to increase its efficiency of operation. The refrigerated merchandiser shroud 16 of the present invention is positioned at the top of the refrigerated merchandiser and may be used as a display for trademarks or advertisements, for example. A preferred refrigerated merchandiser for use with the shroud of the present invention is an ice merchandiser.

Figure 2:
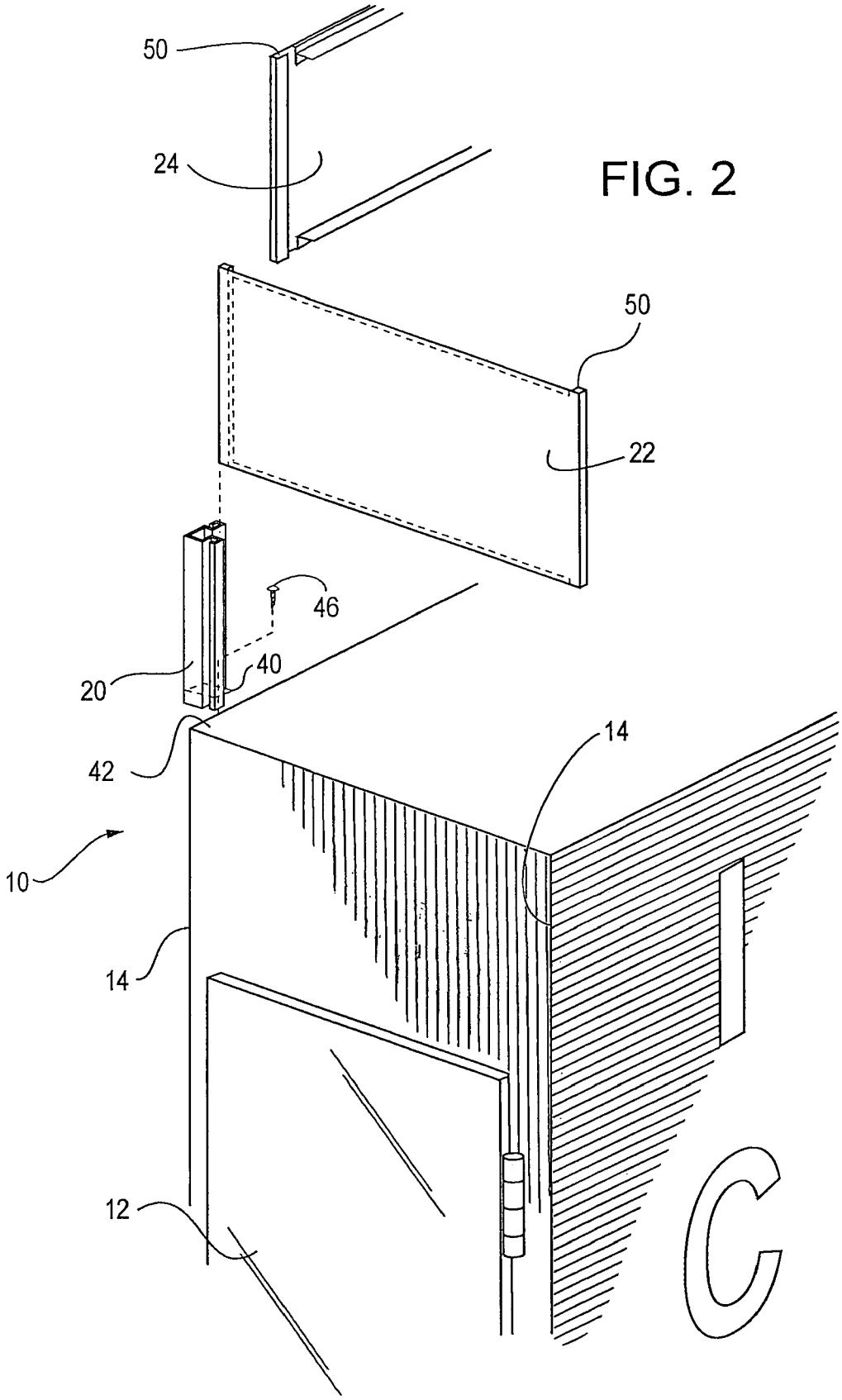
FIG. 2 is an exploded view of a refrigerated merchandiser shroud in accordance with one embodiment of the present invention.

An embodiment of the refrigerated merchandiser shroud 16 of the present invention including four corner bracket assemblies 20 (one shown), a front panel 22, and two side panels 24 (one shown) is illustrated in FIG. 2. Optionally, a back panel may also be provided, positioned between the corner bracket assemblies at the rear of the two side panels 24. The front, side, and optional back panels are referred to generically herein as panels. The corner bracket assemblies 20 are positioned on the refrigerated merchandiser 10 at an upper portion of each of the vertically extending corners 14. Generally, the corner bracket assemblies 20 extend over a short portion of the corner of the refrigerated merchandiser 10 in order to help retain the shroud in place. One or more holes 48 may be provided in the corner bracket assemblies 20 or in the refrigerated merchandiser 10 for receipt of screws or other fasteners. Each of the vertically extending corners 14 of the refrigerated merchandiser 10 is preferably a sharp 90-degree corner, as depicted.

Figure 3A:
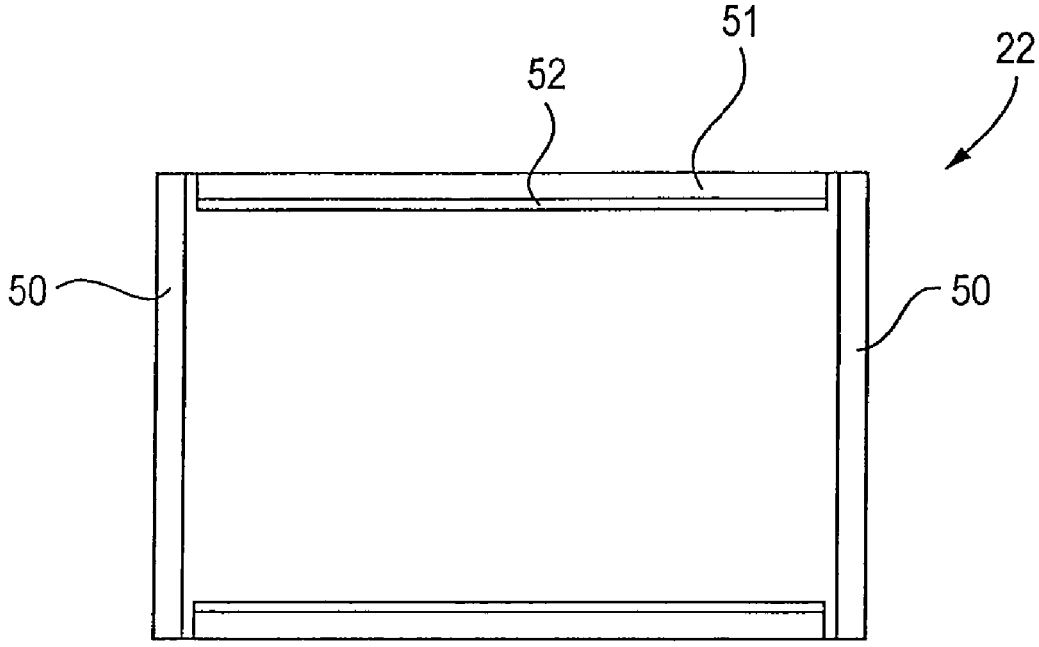
FIG. 3*a* is a side view of a front panel in accordance with an embodiment of the present invention.

FIG. 3*a* illustrates a side view of the inside face of one embodiment of a front panel 22 in accordance with the present invention. The front panel 22 may be formed by folding the edges of a flat panel. On the left and right of the panel is a flat portion which is curled around to form the connecting lip 50. On the top and bottom of the pre-folded front panel 22 are portions of material that are folded back 180° and then folded outwards 90° to form ledges 52. The portion of material running from the edge of the panel to the ledge 52 will be referred to herein as the ledge extension 51. Note that while the front panel 22 may be formed from a flat sheet of material, it may also be formed in other ways and still be within the scope of the present invention.

The inside face of the front panel 22, shown in FIG. 3*a*, faces the top of the refrigerated merchandiser 10, while the outside face is on the other side of the front panel 22. The front panel 22 is typically a thin sheet of pressed metal, although sheets of plastic or other appropriate materials known to those skilled in the art may also be used. The front panel 22 is preferably rectangular in shape, with a connecting lip 50 running along each of two opposite sides of the rectangle. The connecting lip 50 may vary in length; however, it generally runs the length of the sides of the front panel 22. The top and bottom edge of the front panel 22 are formed into a ledge 52 that supports the front panel 22 or side panel 24 in place on the refrigerated merchandiser 10. Running from the ledge 52 to the nearby edge of the panel is the ledge extension 51, which exists due to the way the ledge 52 is formed by folding. Should a ledge 52 be applied directly to the panel, the ledge extension 51 may become unnecessary. Side panels 24 are similar to the front panel 22, in that they are also generally rectangular with two connecting lips 50 on opposite sides; however, the side panels 24 may have different dimensions from the front panel 22. If a back panel (not shown) is provided, it will have a similar configuration. The front, side, and back panels are referred to collectively herein as a panel or the panels. The outside face of any of the panels may be printed with any of a variety of markings if desired.

Generally, the panels will extend downward along the sides of the merchandiser to the same extent as the corner bracket assemblies 20. Preferably, the corner bracket assemblies extend down an inch or less along the sides of the merchandiser. The front panel 22 of the refrigerated merchandiser shroud 16 should not extend downward past the top edge of the door 12 (or other access) where it could interfere with the use of the refrigerated merchandiser 10. The panels are preferably supported on the refrigerated merchandiser 10 by the ledge 52. In the embodiment shown in FIG. 3*a* and FIG. 3*b*, the front panel 22 has a ledge 52 running along the top and bottom, spaced a short distance from each edge. The ledge 52 may be formed by bending a portion of the panel edge back onto itself at a 180° angle, forming the ledge extension 51, and then bending a portion of this bent portion out away from the panel at about a 90° angle. The ledge 52 may also be formed by attaching a long rectangular strip, which may be bent to provide an attachment surface, similar to the ledge extension 51, to the panel by other attachment means such as welding or screws. A panel with a ledge 52 running along both the top and bottom edge has the advantages of being held in place regardless of orientation, and providing a smoother, bent edge along the top edge. The additional folded edge also tends to reinforce the shroud, which is generally made of fairly thin material. These two ledges can be referred to as the top ledge and the bottom ledge, and both should be on the same side (i.e, the outer or inner face) of the panel. While two ledges are thus advantageous, an embodiment with only a single ledge 52 can be used if desired.

Figure 3B:
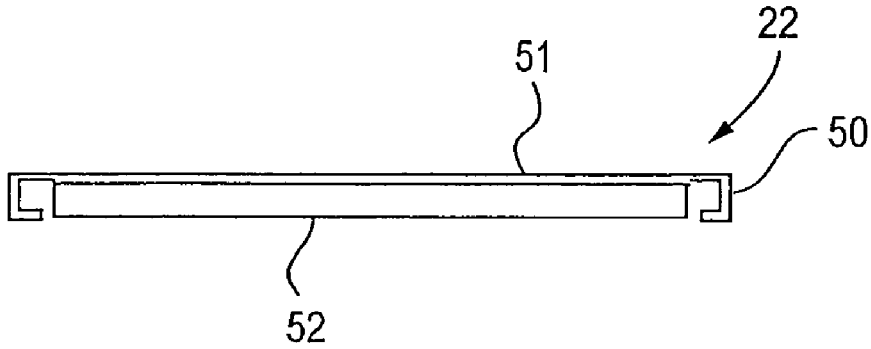
FIG. 3*b* is a top or bottom view of a front panel of FIG. 3*a*.

As already noted, the panels of the refrigerated merchandiser shroud 16 include connecting lips 50 for receipt by the lip holder 32 of corner bracket assemblies 20. In one embodiment, the connecting lip 50 is configured so that it has a generally U-shaped cross section when viewed from the end, as shown in FIG. 3*b*. FIG. 3*b* illustrates a top or bottom view of a front panel 22 in accordance with an embodiment of the present invention. While not shown, a top or bottom view of a side panel 24 would have a similar profile. Essentially, a portion of the panel is formed or bent such that it curves backwards towards the panel. The exact configuration of the connecting lip 50 is not critical so long as it is complementary to the configuration of the lip holder 32 which receives it. While the connecting lips 50 shown in the figures are essentially identical, the connecting lips 50 may be of varying configurations if desired. Preferably the connecting lips 50 are integrally formed in the panels. Alternately, the connecting lips 50 may be a separate component attached to the panels.

Figure 4A:
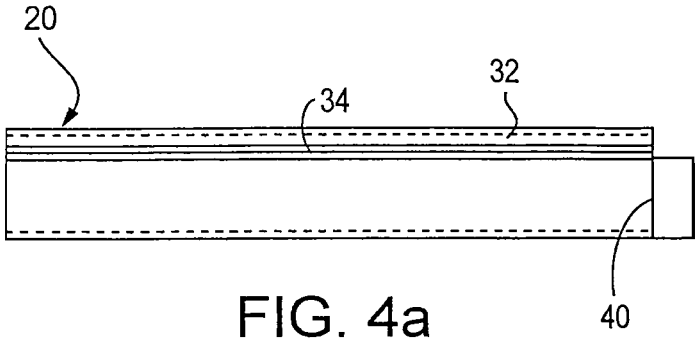
FIG. 4*a* is a side view of an embodiment of a corner bracket assembly of the present invention.
Figure 4B:
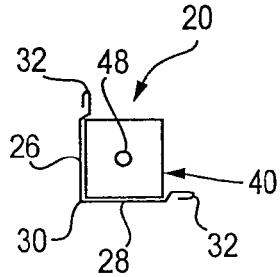
FIG. 4*b* is a top or bottom view of the corner bracket assembly of FIG. 4*a*.

FIGS. 4*a* and 4*b* illustrate side and top views, respectively, of the corner bracket assemblies 20 according to one embodiment of the present invention. The corner bracket assemblies 20 are generally a single piece of material, bent at an angle along the middle such that it fits a corner of the refrigerated merchandiser 10. The corner bracket assembly 20 may be described as including a side piece 26 and a back/front piece 28, the pieces 26 and 28 generally intersecting at a 90° angle at intersection 30. The side piece 26 and back/front piece 28 of the corner bracket assembly 20 are referred to herein as a corner bracket side, or corner bracket sides. While generally formed from a single piece of material, alternately, the corner bracket assembly 20 may be assembled from separate pieces that are joined together. The corner bracket sides need not meet at a sharp 90° angle, although a 90° angle is suited to conventional rectangular refrigerated merchandisers 10. For example, if the vertically extending corners 14 of the refrigerated merchandiser 10 are rounded, the corner bracket sides may be designed to meet in a rounded manner to better fit these corners.

Along the outer edge of each side of corner bracket assembly 20 is a lip holder 32 that includes a groove 34. The lip holder 32, viewed from the end as in FIG. 4*b*, appears to be generally shaped like the letter "U", as viewed from the end, and forms a roughly cylindrical shape that is split by groove 34 where it would otherwise reconnect with the piece if it extended further. The groove 34 allows entry by lip 50 into the lip holder 32 to secure a panel in place once the lip 50 has been slide into the lip holder 32 along a corner bracket side of a corner bracket assembly 20. The exact configuration and length of the lip holder 32 is not critical so long as it is complementary to the configuration of the lip of the panel which it receives. Preferably, the lip holder 32 is integrally formed along the outer edge of a corner bracket side. However, the lip holder 32 may be a separate component attached to a corner bracket side. As shown, the side piece 26 and back/front piece 28 are identical.

FIG. 4*a* illustrates a side view of the corner bracket assembly 20. The corner bracket assembly 20 has a top end and a bottom end, with respect to the refrigerated merchandiser 10 that it is eventually placed upon. A shelf 40 is positioned near the bottom end of the corner bracket assembly 20. Preferably, the shelf 40 is positioned within an inch of the end of the corner bracket assembly 20. Generally, the shelf 40 is attached to the corner bracket assembly 20 by spot welding; however, other means of attachment may be used as known to those skilled in the art. The shelf 40 may be provided with two flanges (not shown) to help secure and position the shelf 40 on the corner bracket assembly 20 by inserting them into small holes (also not shown) present in the sides of the corner bracket assembly 20. During placement of the corner bracket assembly 20 onto the refrigerated merchandiser 10, the shelf 40 of each corner bracket assembly 20 is set on a top corner 42 (See FIG. 2) of the refrigerated merchandiser 10, where it may be attached with one or more TEK screws 46 (See FIG. 2) or other fasteners. The shelf 40 may be provided with one or more small holes 48 to facilitate attachment to the refrigerated merchandiser 10. The corner bracket assemblies 20 thus rest on the top corners 42 of the refrigerated merchandiser 10, with the corner bracket assemblies 20 and the panels extending downwards a short distance along the outside of the refrigerated merchandiser 10; preferably by an inch or less.

The various components of the shroud 16 of the present invention are usually shipped unassembled, and may be shipped either together with or separate from the refrigerated merchandiser 10. Typically, the panels of the shroud 16 are shipped in, for example, a corrugated pack. This avoids damage to the shroud components during shipping, and provides an unobstructed view of the top of the refrigerated merchandiser 10. As the corner bracket assemblies 20 are significantly sturdier than the panels, they may be installed on a new refrigerated merchandiser 10 prior to shipping the refrigerated merchandiser 10. The various components of the shroud 16 may also be shipped and then installed on a refrigerated merchandiser 10 already in use to retrofit the refrigerated merchandiser 10. In such case, the corner bracket assemblies 20 are installed along a top portion of the vertically extending corners 14 of the refrigerated merchandiser 10 on site, and the panels then slipped into place.

Figure 5:
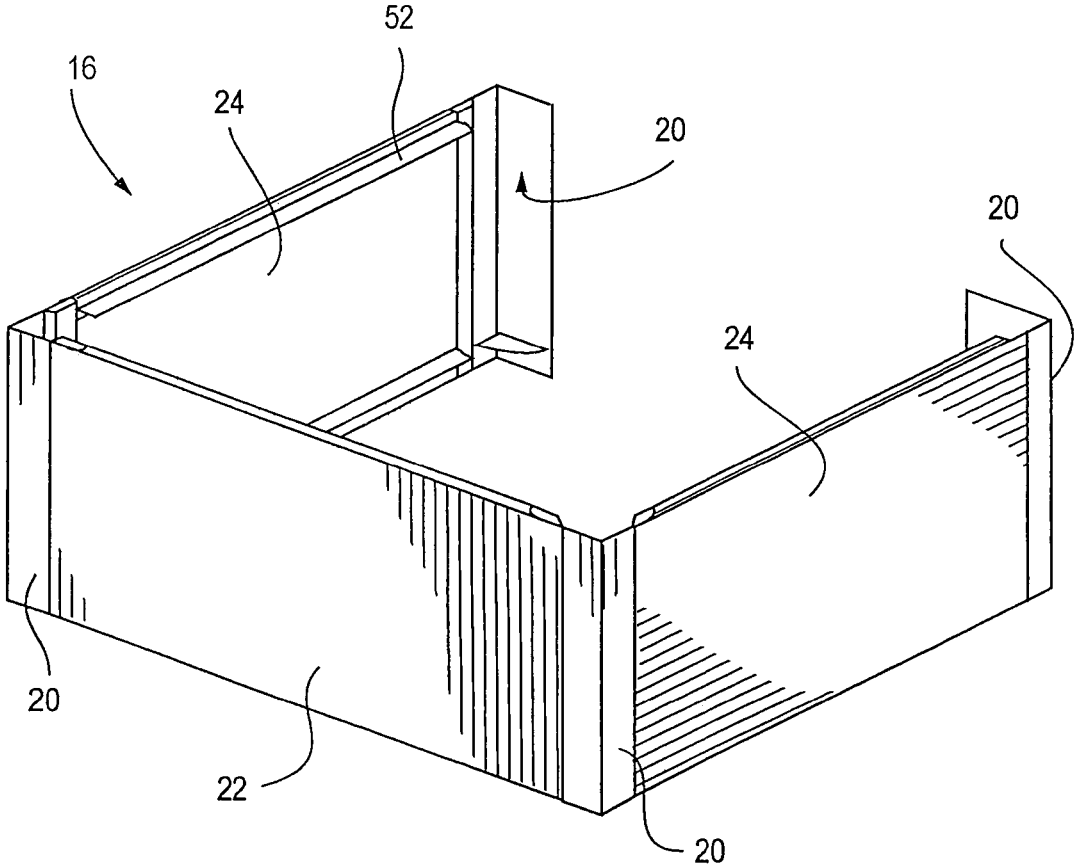
FIG. 5 is a perspective view of an assembled refrigerated merchandiser shroud according to an embodiment of the present invention.

Generally, the refrigerated merchandiser shroud 16 is assembled on top of the refrigerated merchandiser 10 by first installing the corner bracket assemblies 20 and then sliding the panels into place, where they are supported by the ledges 52 of the panels, which rest on the top of the refrigerated merchandiser 10. The panels slide into the corner bracket assemblies 20, with the lip holders 32 and the lips 50 retaining the panels in place along the corner bracket assemblies 20 to form the shroud 16. Other permutations of shipping and assembling the parts of the invention are within the scope of the invention and would be clear to one skilled in the art. Note that while FIG. 5 shows a shroud 16 configured to fit over a generally rectangular surface, the shroud 16 of the present invention may also be configured to fit other surfaces, such as a generally circular surface. This would require the geometry of the panels and the corner bracket assemblies 20 to be altered, for example, by using bowed panels and corner bracket assemblies 20 with a generally rounded rather than V-shaped bracket for a more circular surface.

One advantage of the refrigerated merchandiser shroud 16 of the present invention is that company associates who may handle the refrigerated merchandiser 10 both before and after installation of the shroud 16 are provided with an unobstructed view of the top of the refrigerated merchandiser 10. This allows them to appreciate the limited structural strength of the shroud 16, encouraging them to handle it in a way that avoids damage or possible injury. To assure that there are no accidents, the refrigerated merchandiser shroud 16 of the present invention can be readily uninstalled (broken down) prior to moving the refrigerated merchandiser 10 for service or relocation. As the panels are not fixed in place, this can be done simply and quickly, and without the need for tools.

While various embodiments in accordance with the present invention have been shown and described, it is understood which the invention is not limited thereto, and is susceptible to numerous changes and modifications as known to those skilled in the art. Therefore, this invention is not limited to the details shown and described herein, and includes all such changes and modifications as encompassed by the scope of the appended claims.

What is claimed is:

1. A shroud for a refrigerated merchandiser, comprising:

four corner bracket assemblies each comprising two rectangular sides intersecting at about a 90° angle, the sides each comprising a lip holder positioned along the outer edge of the sides, the lip holder comprising a cylindrical shape split alone its length by a groove, each of the corner bracket assemblies including a flat shelf directly attached to and mounted perpendicular to the two rectangular sides of the corresponding corner bracket assembly; and three or more rectangular panels slidably attached on each side to one of the corner bracket assemblies.

2. The shroud of claim 1, wherein four rectangular panels are slidably attached on each side to a corner bracket assembly.

3. The shroud of claim 1, wherein the rectangular panels each have two connecting lips on opposite edges of the panels, wherein the connecting lips are configured to slidably engage the lip holders of the corner bracket assemblies.

4. The shroud of claim 3, wherein the rectangular panels include a bottom ledge mounted perpendicular to the rectangular panel near the bottom edge of the rectangular panels.

5. The shroud of claim 4, wherein the rectangular panels further include a top ledge mounted perpendicular to the rectangular panel near the top edge of the rectangular panels, wherein the top ledge and the bottom ledge of each rectangular panel extend from the panel in a similar direction.

6. The shroud of claim 1, wherein each of the flat shelves are attached to the corner bracket assemblies a distance from a bottom end of the corner bracket assemblies.

7. The shroud of claim 6, wherein the corner bracket assemblies extend downward from a top surface of a refrigerated merchandiser by the distance when the shroud is mounted to the merchandiser.

8. A shroud, comprising:

four corner bracket assemblies each comprising two rectangular sides intersecting at about a 90° angle and each including a flat shelf directly attached thereto, the sides each comprising a lip holder positioned along the outer edge of the sides, the lip holder comprising a cylindrical shape split along its length by a groove, each of the flat shelves used to secure the shroud to a structure, whereby the flat shelves attach to the structure so as to support the corner bracket assemblies when the shroud is mounted to the structure; and three or more rectangular panels slidably attached on each side to one of the corner bracket assemblies.

9. The shroud of claim 8, wherein the flat shelf of each corner bracket assembly is mounted perpendicular to the two rectangular sides of the corresponding corner bracket assembly.

10. The shroud of claim 8, wherein the rectangular panels each have two connecting lips on opposite edges of the panels, wherein the connecting lips are configured to slidably engage the lip holders of the corner bracket assemblies.

11. The shroud of claim 10, wherein the rectangular panels include a bottom ledge mounted perpendicular to the rectangular panel near the bottom edge of the rectangular panels.

12. The shroud of claim 11, wherein the rectangular panels further include a top ledge mounted perpendicular to the rectangular panel near the top edge of the rectangular panels, wherein the top ledge and the bottom ledge of each rectangular panel extend from the panel in a similar direction.

13. The shroud of claim 8, wherein each of the flat shelves are attached to the corner bracket assemblies a distance from a bottom end of the corner bracket assemblies.

14. The shroud of claim 13, wherein the corner bracket assemblies extend downward from a top surface of the structure by the distance when the shroud is mounted to the structure.

* * * * *

UNITED STATES PATENT AND TRADEMARK OFFICE

CERTIFICATE OF CORRECTION

PATENT NO. : 7,344,210 B2
APPLICATION NO. : 11/357272
DATED : March 18, 2008
INVENTOR(S) : Steve Dresser It is certified that error appears in the above-identified patent and that said Letters Patent is hereby corrected as shown below:

CLAIM 1, Col. 7, line 66
DELETE:
after split "alone"
ADD:
after split --along--

Signed and Sealed this

First Day of July, 2008

JON W. DUDAS
*Director of the United States Patent and Trademark Office*